US005813561A

United States Patent [19]

Chang et al.

[11] Patent Number: 5,813,561

[45] Date of Patent: Sep. 29, 1998

[54] SANITARY BEVERAGE CAN LID

[76] Inventors: Charles Chang; Lucy Chang, both of 55 Westview Rd., Wayne, N.J. 07470

[21] Appl. No.: 808,108

[22] Filed: Feb. 28, 1997

[51] Int. Cl.[6] ..... B65D 17/34

[52] U.S. Cl. ..... 220/269; 220/608; 220/609; 220/906; 206/508; 206/509

[58] Field of Search ..... 220/269, 906, 220/608, 609; 206/508, 509

[56] References Cited

U.S. PATENT DOCUMENTS

| | | | |
|---|---|---|---|
| 2,124,823 | 7/1938 | Kronquest | 220/906 X |
| 2,426,550 | 8/1947 | Coyle | 220/906 X |
| 2,547,059 | 4/1951 | Taylor et al. | 220/906 X |
| 3,858,754 | 1/1975 | Patarini et al. | 220/269 |
| 4,247,014 | 1/1981 | Walz | 220/269 |
| 4,262,815 | 4/1981 | Klein | 220/273 |
| 4,266,688 | 5/1981 | Reid | 220/273 |
| 4,480,763 | 11/1984 | Schneider | 220/269 |

*Primary Examiner*—Stephen Cronin
*Attorney, Agent, or Firm*—Richard A. Joel, Esq.

[57] ABSTRACT

This invention comprises a sanitary beverage can lid wherein the center platform of the lid including the pull tab is raised from below the rim of the can as in conventional cans to a position close to or slightly above the rim of the can. The center platform diameter is reduced in diameter to provide additional space from the exterior of the can body to the edge of the platform. The pull tab is positioned in the middle of the center platform so that the end of the pull tab is at the edge of the center platform to facilitate opening of the can. The raised center platform and the lid design prevent an individual's lip from coming in contact with the groove along the edge of the lid where dirt may accumulate. Another feature is the provision of a raised rim on the platform with an interior drain-back slope so that any excess beverage flows back into the can.

11 Claims, 3 Drawing Sheets

SANITARY BEVERAGE CAN LID

BACKGROUND OF THE INVENTION

This invention relates to beverage cans for soft drinks, beer, juices and the like, with pull off tabs on the upper lid thereof. In particular, the invention is concerned with a sanitary lid wherein the individual drinking directly from the can does not come in contact with the rim groove wherein dirt and debris is likely to accumulate.

This invention is designed to provide a sanitary beverage can lid which eliminates the problems associated with can lids of the prior art. The prior art is rather voluminous but it is not believed that the specific invention disclosed herein is anticipated by any of the prior art patents.

In the prior art, U.S. Pat. No. 4,262,815 to Klein, discloses a conical can with an opening tab at the cone apex merely for nesting purposes. This patent discloses a rather complicated conical can end with a different type pull tab. Further, a critical problem with this conical can is the fact that the weight of stacked-up cases will borne by the conical neck in warehousing and shipping. This requires a very thick and strong material, such as steel, for the conical neck. Also, the design introduces stress to the crimped seal between the neck and the can body whereas in the present invention the cans are stacked on the crimped rim which eliminates the necessity of extra strong lid material and permits the use of recyclable aluminum lids. In contrast to Klein, less space is required in shipping and storage.

U.S. Pat. Nos. 5,108,003 and 5,119,955 to Granofsky disclose the use of a complimentary cover for a beverage can in order to permit sanitary drinking from a can.

U.S. Pat. No. 4,895,270 to Main discloses a sanitary cover for a pop top beverage container comprising an elastic membrane extending over the top and axially along a portion of the side wall of the container.

In another type of container, U.S. Pat. No. 3,946,895 to pugh discloses a container lid with a tear closure and a straw. Another interesting but different proposal for a sanitary drinking can is disclosed in U.S. Pat. No. 4,114,778 to O'Neal which provides an interiorally attached sanitary drinking spout within the container.

Also of interest are U.S. Pat. Nos. 4,407,425; 4,047,634; 3,300,081; 4,318,493; and, 5,415,313.

The foregoing prior art patents disclose various can lids and means for providing a sanitary can opening for drinking directly from a container. The unique concepts proposed by applicant are nowhere seen or suggested in these particular references.

SUMMARY OF THE INVENTION

The present invention relates to beverage cans and in particular to a new and improved sanitary drinking can. The invention includes a lid which is spaced inwardly from the main exterior cylindrical surface of the container and includes a raised center portion or platform extending upwardly immediately adjacent a lid groove portion coupled to the rim on the can exterior. The center portion of the lid includes a large pull tab which is mounted in the middle of the platform and extends substantially to the edge of the center portion. The aperture exposed by pulling the tab, therefore, starts adjacent the rim. As a result, an individual places his lip against the raised center portion rather than against the crimped rim and lid which in the conventional configuration includes a groove extending inwardly from the rim to the center portion of the lid.

In the invention, the center portion is positioned at a height close to or greater than the edge of the rim so that an individual places his lips directly against the center portion which may be wiped clean and does not accumulate the dirt and debris which tend to collect in the conventional rim groove. Also, the raised center portion includes a rim extending upwardly from the groove and sloping internally with a drain-back slope so that excess liquid flows back into the container aperture.

Accordingly, it is an object of this invention to provide a new and improved sanitary lid for a beverage container.

Another object of this invention is to provide a new and improved lid for a beverage can which includes a raised center portion which extends outwardly a distance close to or greater than the can rim and includes a groove along the central rim which is small in relation to the circumference of the lid.

Another object of this invention is to provide a new and improved beverage container including a raised center platform extending above the outer rim and a drain-back slope extending inwardly from the edge of the platform so that excess beverage flows back into the aperture in the center platform.

A more specific object of this invention is to provide a new and improved sanitary drinking can wherein the can includes a sloped upper portion terminating in a rim and a lid mounted to the rim and having a central portion extending outwardly a distance close to or greater than the height of the rim and including a pull tab mounted to expose an opening at the periphery of the central portion so that an individual's lip does not come in contact with the can body and groove but substantially only the center portion of the lid to eliminate the possibility of an unsanitary situation involving dirt which generally becomes lodged in the groove between the rim and the lid in conventional cans.

BRIEF DESCRIPTION OF THE DRAWINGS

The above and other objects and advantages of the invention may be more clearly shown when viewed in conjunction with the accompanying drawings wherein.

DETAILED DESCRIPTION OF THE INVENTION

Figure 1:
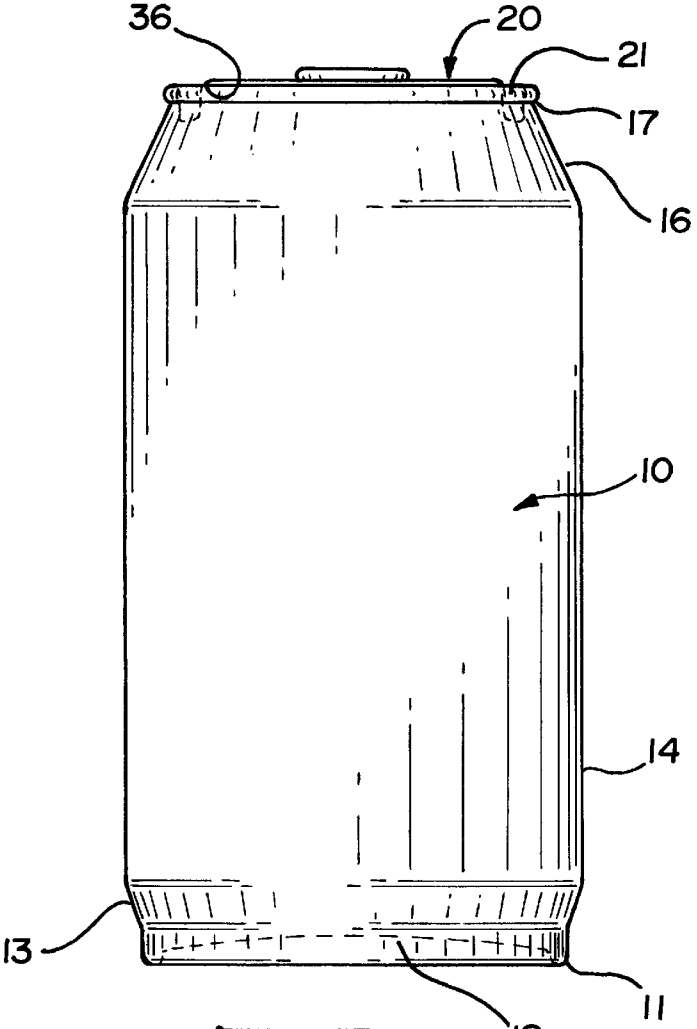
FIG. 1 discloses a beverage can, including the invention, from a front view.

Referring now to the drawings, FIG. 1 discloses a front view of a beverage can 10 with a lid 20 comprising the invention. The can 10 includes a base portion 11 which includes a concave recess 12 and a tapered transition portion 13 extending outwardly from the base 11 to the exterior cylindrical wall 14. The top portion of the can 10 comprises a transition section 16 extending inwardly from the wall 14 and terminating at the rim 17.

Figure 2:
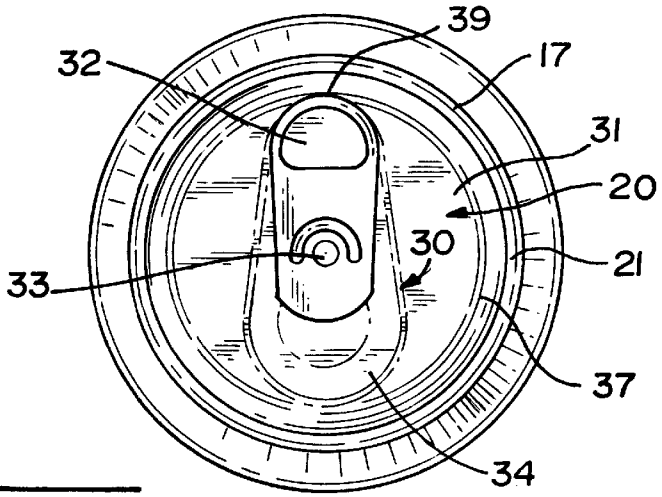
FIG. 2 shows an upper view of the beverage can of FIG. 1 and particularly the sanitary lid with the pull tab in position.
Figure 4:
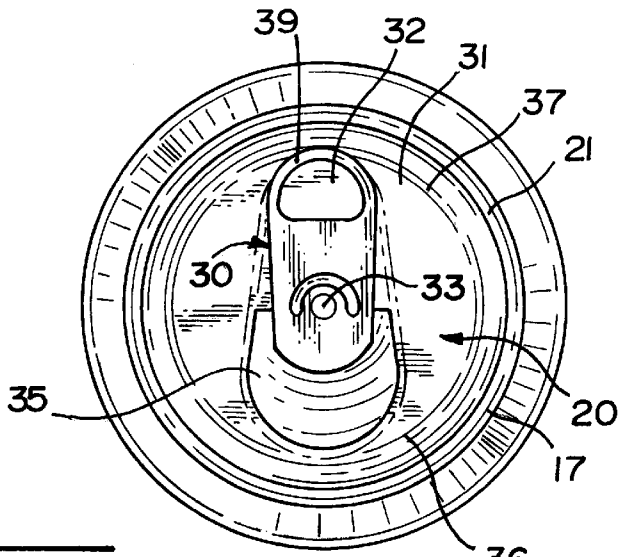
FIG. 4 is a top view of the lid after the tab has been manipulated to expose an opening into the can.

The lid 20 is mounted to the transition portion 16 at rim 17 by crimping and sealing the lid 20 over the rim 17. The lid 20 includes a recess or groove 21 formed by the crimping and extending circumferentially about the outer portion of the lid 20 adjacent to the rim 17. A conventional pull tab 30 is mounted on the upper surface or center portion 31 of the lid 20 and includes an opening 32 which permits grasping by an individual and pivoting about the connector post 33 to drive the die-cut portion 34 of the lid 20 into the can 10 as shown in FIG. 4. The opening 35, which, is positioned adjacent the inner portion 36 of the recess 21 and the platform 31 is equal to or higher than the outer edge or rim 17 of the lid 20. Positioning the pull tab 30 in the middle of the center platform 31 and having the end 39 at the edge of the platform 31 facilitates opening the can 10 since it is easy to lift the pull tab 30.

In essence, the lower the platform aperture 35, the closer it needs to be to the center of the lid 10 while the higher the platform 31, the further away the aperture 35 can be located. Once the platform 31 is above the rim height, the opening can be adjacent the edge 37.

Figure 3:
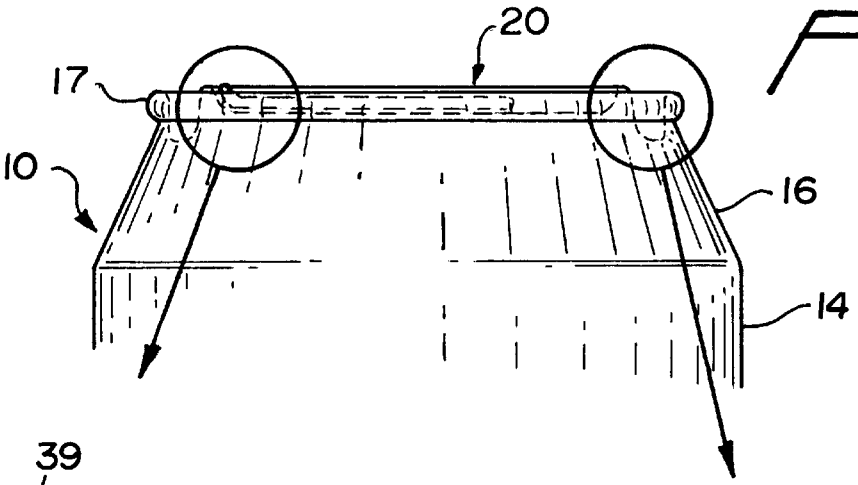
FIG. 3 is a side view of the beverage can with the exploded views 3A and 3B showing the details thereof.
Figure 3B:
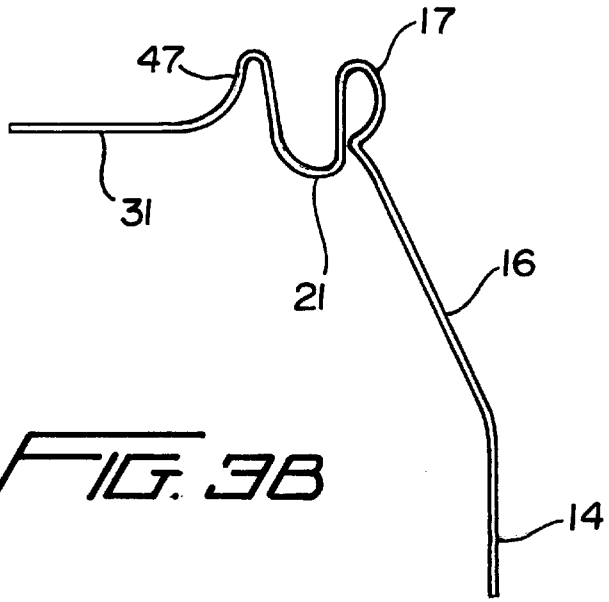
Figure 3A:
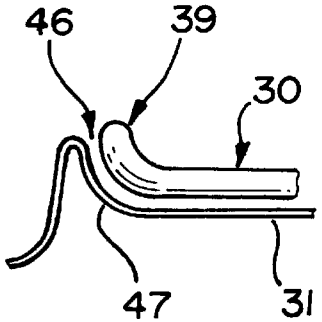

In FIG. 3, the enlarged views FIGS. 3A and 3B depict details of the can 10 more clearly. For example, FIG. 3A, the tab 30 curves upwardly with a small gap 46 between the tab 30 and the drain-back slope 47 for ease of opening. The rim height, however, is sufficiently high to prevent unintentional lifting of the tab 30. In FIG. 3B, the 360° drain-back feature is shown which facilitates excess liquid flowing back into the can 10 rather than the groove 21. The large radius of the slope 47 permits easy cleaning. Usually, the rim 17 and central platform 31 are symmetrically round to facilitate stacking. In an alternate design, the central platform 31 would not be symmetrical through 360°.

Figure 6A:
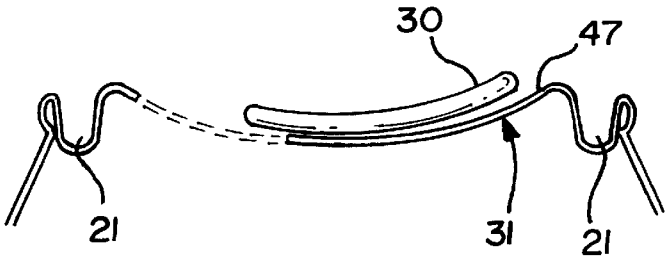
FIGS. 6A, B and C show variations in the lid design including a drain-back slope leading to the can aperture.
Figure 6B:
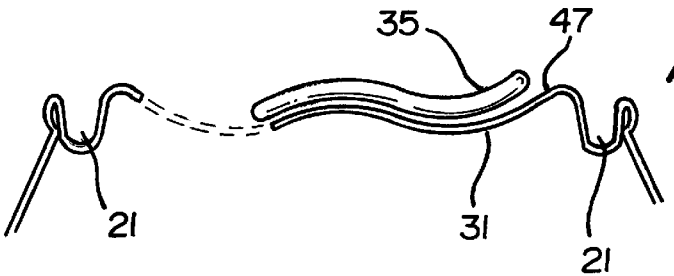
Figure 6C:
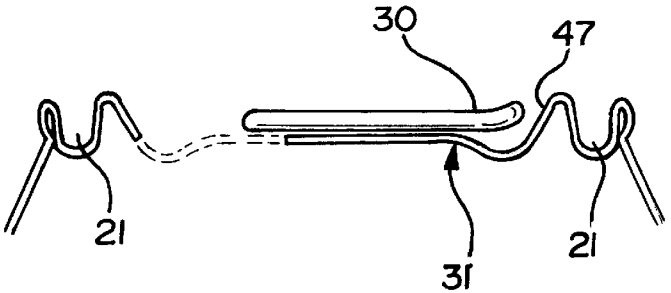

FIGS. 6*a*–6*c* illustrate various versions of the drain-back slope 47 with the conventional groove 21 and crimped rim 33. The pull tab 30 is shown in various locations and various configurations on the platforms 31. Since the indented groove formed by the slope 47 is shallower than the groove 21, it is much easier to clean. The positioning of the tab 30 is important so as to permit cleaning under the tab 30.

The center portion or platform 31 is reduced in diameter from conventional cans 10 to provide a greater spacing or gap between the edge 37 of the center platform 31 and the rim 17 of the can 10. The object is to permit one's lower lip to rest along the center platform 31 when drinking. Thus, one's lip and the beverage contents avoid contact with groove 21 when drinking directly form the can 10. One can readily wipe clean the raised center platform 31 without digging into the groove 21 in an attempt to clean it.

As a result of the above design, it is possible for an individual to drink directly from the opening 35 without his lip touching the "dirt" (not shown) which might have accumulated in the recess 21. First, by providing a lid 20 wherein the upper platform surface 31 is raised above the outer rim 178 and the tab 30 extends to the edge 37 of the platform 31, the possibility of having dirt or other debris within the reduced recess 21 is minimized or eliminated as well as the chances of coming in contact with the dirt during drinking.

As a further advantage, the new and improved container 10 facilitates stacking since the rim 17 and cylindrical wall portion 14 bear the weight of a second container. Thus, it is possible to use aluminum lids 20 rather than extra strength materials and it is possible to use existing warehousing and shipping materials.

Figure 5:
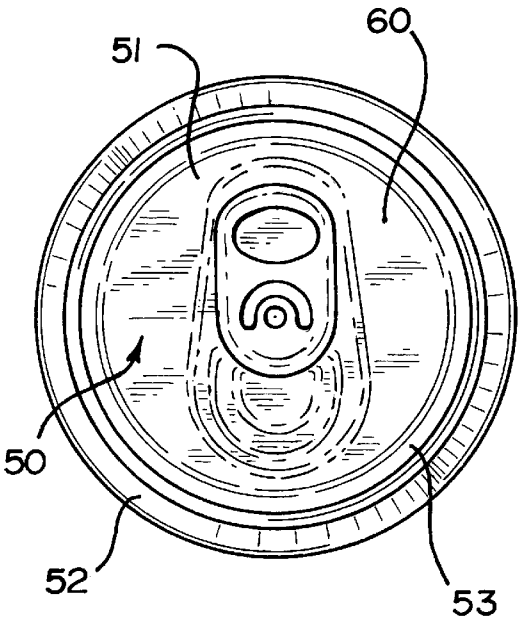
FIG. 5 PRIOR ART
FIG. 5 shows the prior art design.

Conventional cans 60 have a deep groove 53 which collects dust and dirt in the shipping and handling process. A typical prior art lid 50 is shown in FIG. 5. The lid 50 has no raised center portion 31 and the surface 51 is below the rim 52 having a groove 53 adjacent the rim 52. This groove 53 is a problem with the accumulation of dirt and debris.

While the invention has been explained by a detailed description of certain specific embodiments, it is understood that various modifications and substitutions can be made in any of them within the scope of the appended claims which are intended also to include equivalents of such embodiments.

What is claimed, is:

1. A flat end sanitary drinking container for liquids comprising:

a main body portion having a base and a hollow cylindrical wall portion extending outwardly therefrom at one end and a rim formed at the other end of said portion;

a lid having outer edges mounted to the rim and extending over the hollow cylindrical wall portion, a recessed portion adjacent the rim and a central portion extending upwardly from the recess a predetermined distance close to the rim, an aperture and a pull tab mounted on the central portion over the aperture wherein the extending central portion permits drinking from the aperture avoiding the recessed portion;

wherein the central portion includes an inner integral rim portion extending upwardly from the recess to prevent liquid from flowing into the narrow recess and having a slope extending inwardly towards the aperture to permit liquid to drain back into the aperture; and, wherein the slope includes a large radius to facilitate cleaning and wherein the lid extends upwardly at the end of said slope forming a recess on the lid and wherein the tab extends outwardly over the recess for ease of opening.

2. A flat end sanitary drinking container for liquids in accordance with claim 1 wherein:

the position of the opening varies with the height of the central portion, being located closer to the center of the central portion if the height of the inner rim is lower with respect to the outer rim and towards the edge of the central portion with a higher inner rim.

3. A flat end sanitary drinking container for liquids in accordance with claim 1 wherein:

the container permits the stacking of a second similar container thereon wherein the rim and the cylindrical wall portion bear the weight of the second container.

4. A flat end sanitary drinking container for liquids in accordance with claim 1 wherein:

the central portion is asymmetrical having a deep groove in a portion thereof.

5. A flat end sanitary drinking container for liquids in accordance with claim 1 wherein:

the central portion includes an intermediate portion extending upwardly, an inner rim at the end of the intermediate portion sloping slighty downwardly and a substantially flat central portion the end of the slope; and, the lid is crimped over the rim at its ends and extends downwardly therefrom forming a narrow recess having an interior portion extending upwardly to the central portion.

6. A flat end sanitary drinking container for liquids in accordance with claim 5 wherein:

the pull tab extends across an intermediate portion of the central portion to the upwardly extending interior portion of the recess whereby the aperture covered by the tab extend is to the edge of the central portion to facilitate drinking from the aperture and avoiding the recess.

7. A flat end sanitary drinking container for liquids in accordance with claim 5 wherein:

the pull tab is positioned in the middle of the center platform and includes an end portion extending to the edge of the platform to facilitate opening the container.

8. A flat end sanitary drinking container for liquids in accordance with claim 1 wherein the central portion further includes:

an inner integral rim portion extending upwardly from the recess to prevent liquid from flowing into the narrow recess and having a slope extending inwardly towards the aperture to permit liquid to drain back into the aperture.

9. A flat end sanitary drinking container for liquids in accordance with claim 8 wherein:

the pull tab includes a curved outer end mounted adjacent the slope and having a predetermined space therebetween to facilitate opening the tab.

10. A flat end sanitary drinking container for liquids in accordance with claim 8 wherein:

the inner rim height is sufficiently high to prevent unintentional lifting of the pull tab.

11. A flat end sanitary drinking container for liquids in accordance with claim 8 wherein:

the inner rim portion and central portion are symmetrically round and the can base is slightly concave to facilitate stacking.

* * * * *